US011076473B2

(12) United States Patent
Pamato et al.

(10) Patent No.: US 11,076,473 B2
(45) Date of Patent: Jul. 27, 2021

(54) METHOD FOR DETECTING A DEFECT IN AN LED STRING AND ELECTRONIC CIRCUIT WITH AT LEAST ONE LED STRING

(71) Applicant: Infineon Technologies AG, Neubiberg (DE)

(72) Inventors: Marco Pamato, Schio (IT); Damiano Sartori, Padua (IT); Gernot Unterweger, Latschach (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 16/696,356

(22) Filed: Nov. 26, 2019

(65) Prior Publication Data

US 2020/0187323 A1 Jun. 11, 2020

(30) Foreign Application Priority Data

Dec. 11, 2018 (DE) ..... 10 2018 131 803.0

(51) Int. Cl.

| | |
|---|---|
| ***H05B 45/50*** | (2020.01) |
| ***H05B 45/58*** | (2020.01) |
| ***H05B 47/23*** | (2020.01) |
| ***H05B 45/14*** | (2020.01) |

(52) U.S. Cl.

CPC ..... *H05B 47/23* (2020.01); *H05B 45/14* (2020.01); *H05B 45/58* (2020.01)

(58) Field of Classification Search

CPC ..... H05B 33/083; H05B 33/089; H05B 33/0896; H05B 45/14; H05B 45/48; H05B 45/50; H05B 45/56; H05B 45/58; H05B 47/10; H05B 47/23

See application file for complete search history.

(56) References Cited

U.S. PATENT DOCUMENTS

| | | | | |
|---|---|---|---|---|
| 9,502,958 | B2 * | 11/2016 | Pamato | H05B 45/58 |
| 2008/0202312 | A1 * | 8/2008 | Zane | H05B 31/50 84/297 R |
| 2012/0074856 | A1 * | 3/2012 | Takata | H05B 45/48 315/192 |
| 2012/0074947 | A1 * | 3/2012 | Cortigiani | H05B 45/10 324/414 |
| 2014/0247432 | A1 * | 9/2014 | Yanase | H05B 45/58 353/85 |
| 2014/0327359 | A1 * | 11/2014 | Masazumi | H05B 45/60 315/122 |
| 2018/0359824 | A1 * | 12/2018 | Pamato | H05B 45/54 |
| 2020/0092962 | A1 * | 3/2020 | Sartori | H05B 45/58 |

FOREIGN PATENT DOCUMENTS

| | | | |
|---|---|---|---|
| DE | 102008058524 | A1 | 5/2010 |
| DE | 102009017989 | A1 | 10/2010 |

* cited by examiner

*Primary Examiner* — Thai Pham
(74) *Attorney, Agent, or Firm* — Slater Matsil, LLP

(57) ABSTRACT

A method and an electronic circuit are disclosed. The method includes detecting at least one operating parameter in an electronic circuit that includes a monitored LED string; adjusting a voltage threshold based on the at least one detected operating parameter; detecting a string voltage across the monitored LED string; comparing the string voltage with the voltage threshold; and detecting a defect in the LED string based on the comparing.

16 Claims, 11 Drawing Sheets

METHOD FOR DETECTING A DEFECT IN AN LED STRING AND ELECTRONIC CIRCUIT WITH AT LEAST ONE LED STRING

This application claims the benefit of German Application No. 102018131803.0, filed on Dec. 11, 2018, which application is hereby incorporated herein by reference.

TECHNICAL FIELD

This disclosure in general relates to a method for detecting a defect in an LED (Light Emitting Diode) string and an electronic circuit with at least one LED string.

BACKGROUND

LED strings, which include a plurality of LEDs connected in series, are widely used for lighting purposes in various kinds of applications such as interior or exterior lighting in automobiles, or lighting in buildings, to name only a view. An LED string may be driven by a drive circuit that generates a drive current received by the LED string. The drive circuit may also be configured to monitor the LED string and detect a defect of one of the LEDs in the LED string. The defect may include a short circuit in one of the LEDs in the string.

Detecting a defect in a system with at least one LED string may include measuring a voltage across the LED string and comparing the measured voltage with a threshold predefined by the manufacturer of the system and stored in a memory of the system. This type of detecting the defect is based on the assumption that the voltage across the LED string (string voltage) is higher than the threshold when each of the LEDs in the string is lit up and that the string voltage falls below the threshold when a short circuit in one of the LEDs occurs. The string voltage is essentially proportional to the number of LEDs in the string and the forward voltage of the LEDs. A reduction of the string voltage when a short circuit in one LED occurs is essentially proportional to a reciprocal of the number n of LEDs in the string. When, for example, the string includes n=2 LEDs and a short circuit in one of the LEDs occurs the string voltage drops for about 50% (=1/n), and when, for example, the string includes n=10 LEDs and a short circuit in one of the LEDs occurs the string voltage drops for about 10% (=1/n). The threshold should be adjusted such that the voltage change caused by a short circuit in one of the LEDs is detected and that variations of the string voltage, which may result from temperature changes, do not result erroneously in the detection of a defect. Suitably selecting the threshold is, in particular, challenging when the number of LEDs increases and a change of the string voltage that has to be reliably detected decreases.

There is therefore a need for a method that reliably detects a defect in an LED string, in particular, an LED string with more than five LEDs.

SUMMARY

One example relates to a method. The method includes detecting at least one operating parameter in an electronic circuit that comprises a monitored LED string, adjusting a voltage threshold based on the at least one detected operating parameter, detecting a string voltage across the monitored LED string, comparing the string voltage with the voltage threshold, and detecting a defect in the LED string (3) based on the comparing.

Another example relates to an electronic circuit. The electronic circuit includes a monitored LED string, and a defect detection circuit. The defect detection circuit is configured to detect at least one operating parameter in the electronic circuit, to adjust a voltage threshold based on the at least one detected operating parameter, to detect a string voltage across the monitored LED string, to compare the string voltage with the voltage threshold, and to detect a defect in the LED string based on the comparing.

BRIEF DESCRIPTION OF THE DRAWINGS

Examples are explained below with reference to the drawings. The drawings serve to illustrate certain principles, so that only aspects necessary for understanding these principles are illustrated. The drawings are not to scale. In the drawings the same reference characters denote like features.

DETAILED DESCRIPTION OF ILLUSTRATIVE EMBODIMENTS

In the following detailed description, reference is made to the accompanying drawings. The drawings form a part of the description and for the purpose of illustration show examples of how the invention may be used and implemented. It is to be understood that the features of the various embodiments described herein may be combined with each other, unless specifically noted otherwise.

Figure 1:
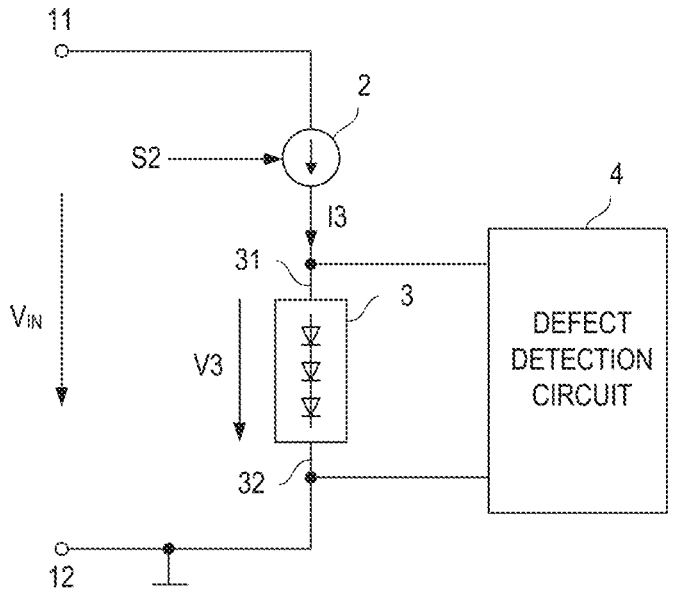
FIG. 1 illustrates one example of an electronic circuit that includes an LED string.

FIG. 1 illustrates one example of an electronic circuit that includes an LED string 3 and a defect detection circuit 4 configured to detect a defect in the LED string 3. Referring to FIG. 1, the LED string 3 includes a first circuit node 31 and a second circuit node 32, which are also referred to as first string node 31 and second string node 32 in the following. A voltage V3 between the first string node 31 and the second string node 32 is referred to as string voltage in the following. The defect detection circuit 4 is configured to detect the string voltage V3 in order to detect a defect in the LED string. For detecting the string voltage V3, the defect detection circuit 4 may be connected to the first and second string nodes 31, 32, as illustrated in FIG. 1.

Figure 2:
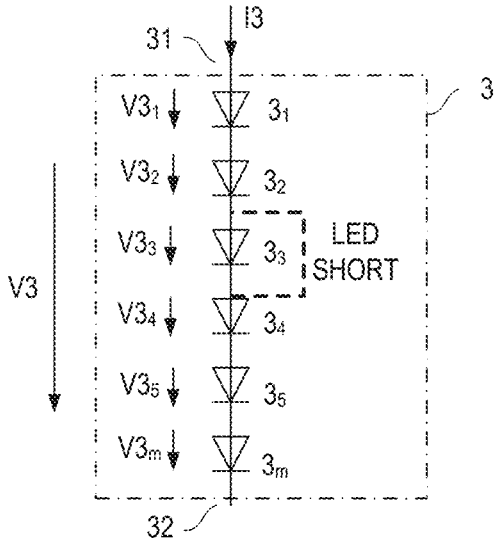
FIG. 2 illustrates one example of an LED string in greater detail.

The LED string 3 includes a plurality (two or more) of LEDs. One example of the LED string 3 is illustrated in FIG. 2. Referring to FIG. 2, the LED string 3 may include a plurality of LEDs $\mathbf{3}_1$-$\mathbf{3}_m$ connected in series between the first string node 31 and the second string node 32.

When the electronic circuit is in operation, the LED string 3 may receive a string current I3, which is a current flowing between the first string node 31 and the second string node 32. Dependent on a current level of the string current I3 the LEDs $\mathbf{3}_1$-$\mathbf{3}_m$ of the string 3 light up or do not light up. In the following, "on" and "off" are used interchangeably in place of "light up" and "do/does not light up", respectively.

The overall number of LEDs in the LED string 3 can range from 2 to 50, in particular from 2 to 30. Just for the purpose of illustration, the LED string 3 shown in FIG. 2 includes m=6 LEDs $\mathbf{3}_1$-$\mathbf{3}_m$ connected in series.

According to one example, the LEDs $\mathbf{3}_1$-$\mathbf{3}_m$ connected in series in the LED string 3 are LEDs of the same type, so that, at a given string current I3, the LEDs $\mathbf{3}_1$-$\mathbf{3}_m$ light with essentially the same intensity, when the string current I3 is above a threshold that causes the LEDs $\mathbf{3}_1$-$\mathbf{3}_m$ to light up.

During operation of the LED string 3, a defect may occur. One type of defect that may occur is a short circuit of one single LED. This type of defect is briefly referred to as LED short in the following. In the case of an LED short, the defect (shorted) LED is off, while the remainder of the LEDs in the LED string 3 is still on. An example of an LED short in one $3_3$ of the LEDs $\mathbf{3}_1$-$\mathbf{3}_m$ of the LED string 3 is illustrated in bold dashed lines in FIG. 2. In this example, LED $\mathbf{3}_3$ is off and the remainder $\mathbf{3}_1$-$\mathbf{3}_m$, $\mathbf{3}_4$-$\mathbf{3}_m$ of the LEDs are on when a string current I3 higher than a certain current threshold flows through the LED string 3.

Referring to FIG. 2, the string voltage V3 is essentially given by a sum of voltages $V\mathbf{3}_1$-$V\mathbf{3}_m$ across the individual LEDs $\mathbf{3}_1$-$\mathbf{3}_m$ in the string 3. When a string current I3 is driven into the string 3 that causes the LEDs $\mathbf{3}_1$-$\mathbf{3}_m$ to light up and when the LEDs $\mathbf{3}_1$-$\mathbf{3}_m$ are of the same type, the LED voltages $V\mathbf{3}_1$-$V\mathbf{3}_m$ are essentially the same. Thus, when there is no defect in the string 3, the string voltage V3 is essentially proportional to the number m of LEDs $\mathbf{3}_1$-$\mathbf{3}_m$ connected in series. When an LED short occurs and the string current I3 does not change, the string voltage V3 drops because the voltage ($V\mathbf{3}_3$ in the example shown in FIG. 2) across the shorted LED ($\mathbf{3}_3$ in the example shown in FIG. 2) essentially drops to zero.

Referring to FIG. 1, the string current I3 may be generated by a current source 2 connected in series with the LED string 3, wherein a series circuit including the LED string 3 and the current source 2 is connected between input nodes 11, 12 where an input voltage $V_{IN}$ is available. The current source 2 may be a switched current source that switches on or off dependent on an input signal S2. According to one example, the current source 2 is configured to generate a string current I3 that causes the LEDs in the LED string 3 to light up when the input signal S2 has an on-level and to generate a current level of the string current I3 such that the LEDs $\mathbf{3}_1$-$\mathbf{3}_m$ are off when the input signal S2 has an off-level.

Figure 3:
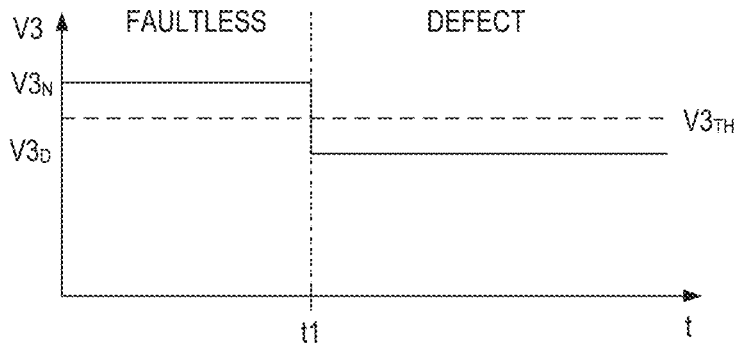
FIG. 3 schematically illustrates a voltage across the LED string (string voltage) in a faultless state and after an LED short has occurred.

Basically, detecting an LED short may include detecting the string voltage V3 and comparing the string voltage V3 with a voltage threshold $V\mathbf{3}_{TH}$. This is illustrated in FIG. 3 which schematically illustrates a timing diagram of the string voltage V3. In this example, an LED short in one of the LEDs $\mathbf{3}_1$-$\mathbf{3}_m$ occurs at a first time instance t1, so that at the first time instance t1 the string voltage V3 drops from a first voltage level $V\mathbf{3}_N$, which is referred to as faultless level in the following, to a second voltage level $V\mathbf{3}_D$, which is referred to as defect level in the following. The faultless level $V\mathbf{3}_N$ is essentially given by $V\mathbf{3}_N$=m $V\mathbf{3}_F$, wherein $V\mathbf{3}_F$ is the voltage across each of the LEDs $\mathbf{3}_1$-$\mathbf{3}_m$ when the LEDs are switched on (lights up) and when the LEDs $\mathbf{3}_1$-$\mathbf{3}_m$ are of the same type. This voltage $V_F$ is also referred to as forward voltage in the following. The defect level is essentially given by $V\mathbf{3}_D=(m-1)\cdot V\mathbf{3}_F$, so that the difference $V\mathbf{3}_N-V\mathbf{3}_D$ between the faultless level and the defect level is essentially given by $V\mathbf{3}_F$. In order to detect this type of defect, the voltage threshold $V\mathbf{3}_{TH}$ is selected such that it is between the faultless level $V\mathbf{3}_N$ and the defect level $V\mathbf{3}_D$, that is, $V\mathbf{3}_N>V\mathbf{3}_{TH}>V\mathbf{3}_D$. For several reasons, however, the string voltage V3 may vary so that situations may occur in which comparing the string voltage V3 with a fixed voltage threshold $V\mathbf{3}_{TH}$ does not result in reliably detecting an LED short. Some examples are explained in the following.

Figure 4:
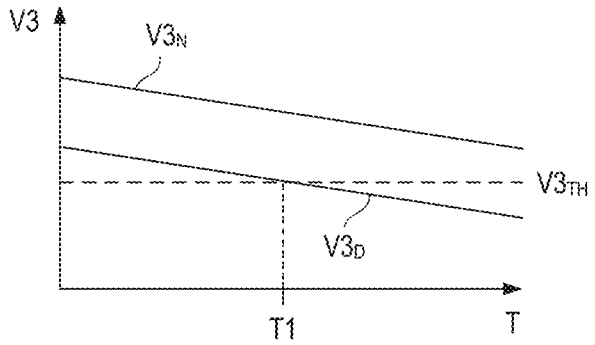
FIG. 4 schematically illustrates a dependency of the string voltage on a temperature of the LED string.

Referring to FIG. 4, the string voltage V3 is dependent on a temperature of the LED string 3, wherein the string voltage V3 decreases as the temperature T decreases. FIG. 4 schematically illustrates the faultless level $V\mathbf{3}_N$ and the defect level $V\mathbf{3}_D$ dependent on the temperature T. In this example, when the temperature T is below a temperature threshold T1 each of the faultless level $V\mathbf{3}_N$ and the defect level $V\mathbf{3}_D$ is above the threshold $V\mathbf{3}_{TH}$, so that detecting an LED short would not be possible at temperatures below the voltage threshold T1. Moreover, at high temperatures, the faultless level $V\mathbf{3}_N$ may fall below the threshold $V\mathbf{3}_{TH}$ so that there is only a certain temperature range in which detecting an LED short by comparing the string voltage V3 with a fixed threshold $V\mathbf{3}_{TH}$ works reliably.

Figure 5:
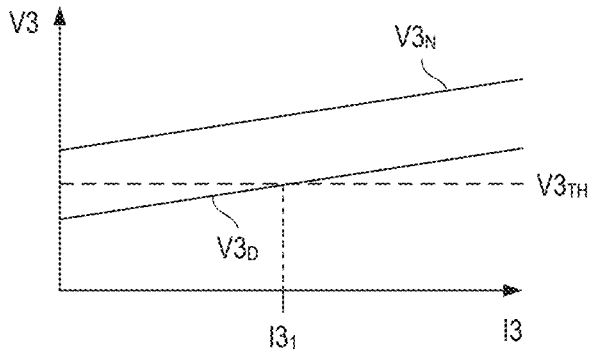
FIG. 5 schematically illustrates a dependency of the string voltage on a current through the LED string.

Referring to FIG. 5, the string voltage V3 is further dependent on the string current I3, wherein the string voltage V3 increases as the string current I3 increases. FIG. 5 shows the faultless level $V\mathbf{3}_N$ and the defect level $V\mathbf{3}_D$ dependent on the string current I3. Referring to FIG. 5, the defect level $V\mathbf{3}_D$ becomes higher than the fixed threshold $V\mathbf{3}_{TH}$ when the string current I3 is higher than a current threshold $I\mathbf{3}_1$. Thus, reliably detecting an LED short might no longer be possible when, by virtue of current variations, the string current I3 rises above the current threshold $I\mathbf{3}_1$.

Figure 6:
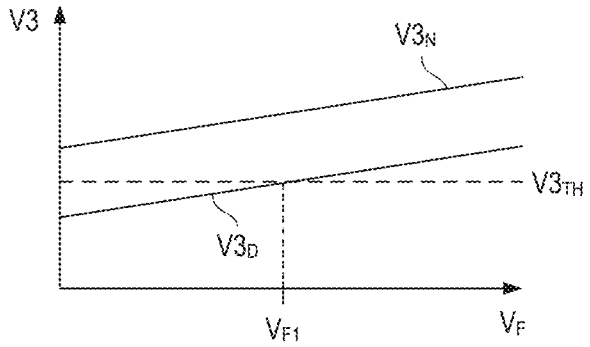
FIG. 6 schematically illustrates a dependency of the string voltage on a forward voltage of LEDs of the LED string.

Further, referring to FIG. 6, the string voltage V3 is also dependent on the forward voltage $V_F$ of the LEDs $\mathbf{3}_1$-$\mathbf{3}_m$ in the LED string 3. The forward voltage $V_F$ is the voltage across a single LED at a certain string current that causes the LED to light up. Due to variations in the manufacturing process of the LEDs, different LEDs may have different forward voltages $V_F$. In some cases, when assembling an LED string, LEDs with essentially the same forward voltage are selected so that different LED strings with the same number of LEDs and receiving a string current with the same level may have significantly different string voltages V3. Thus, in some LED strings, the defect level, at a given string current I3, may be higher than the threshold voltage $V3_{TH}$, so that a reliable LED short detection is not possible in these LED strings.

Figure 7:
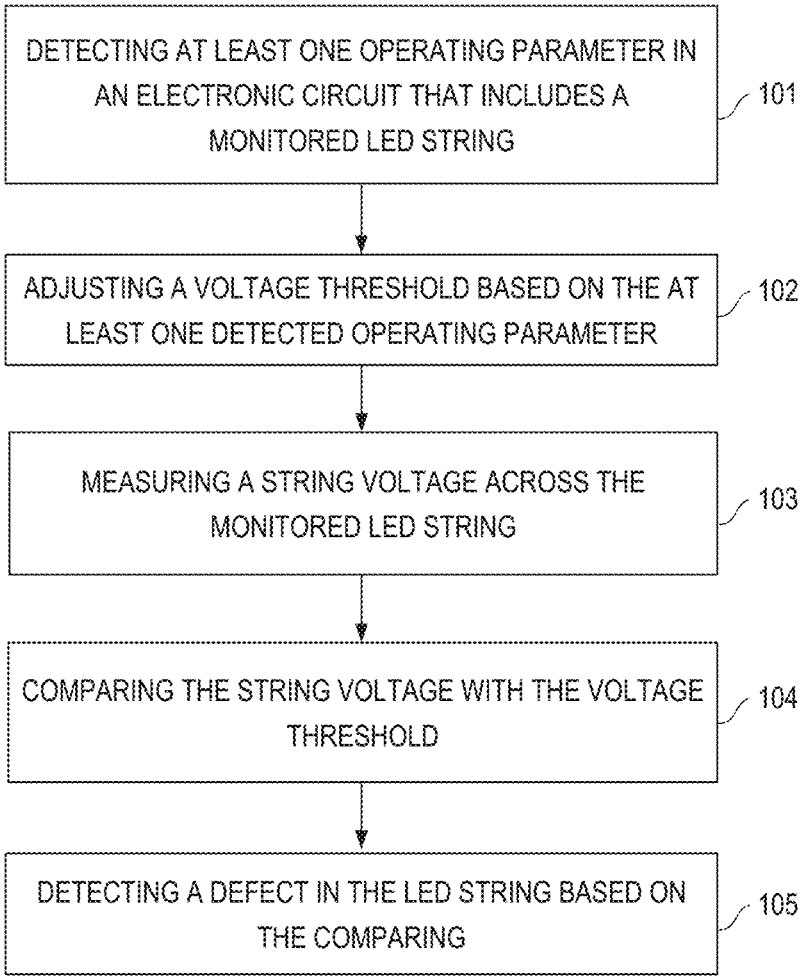
FIG. 7 shows a flowchart of one example of a method for detecting a defect in an LED string.

FIG. 7 illustrates a flowchart of a method which, in spite of string voltage V3 variations of the type explained with reference to FIGS. 4 to 6, is capable of reliably detecting an LED short in an LED string 3. Referring to FIG. 7, the method includes detecting at least one operating parameter in the electronic circuit that includes the LED string 3 (101). This LED string 3 is also referred to as monitored LED string in the following. The method further includes adjusting a voltage threshold based on the at least one detected operating parameter (102), measuring the string voltage across the monitored LED string (103), comparing the string voltage with the voltage threshold (104), and detecting a defect in the LED string based on the comparing (105). By detecting the at least one operating parameter and adjusting the voltage threshold based on the at least one detected operating parameter, the method is robust against changes of the string voltage that are not due to an LED short, such as changes of the type explained with reference to FIGS. 4 to 6.

Figure 8:
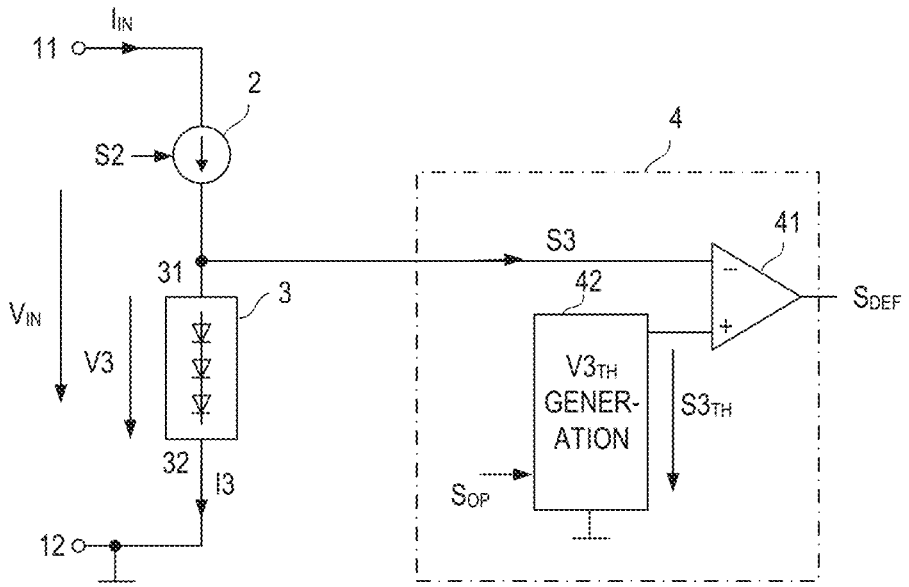
FIG. 8 shows a circuit diagram of an electronic circuit with an LED string and an adaptive defect detection circuit.

FIG. 8 shows one example of a defect detection circuit 4 that is configured to operate in accordance with the method illustrated in FIG. 7. Referring to FIG. 8, the defect detection circuit 4 includes a comparator 41 and a voltage threshold generation circuit 42, wherein the comparator 41 receives a signal S3 representing the string voltage V3 and a threshold signal $S3_{TH}$ representing the voltage threshold $V3_{TH}$ and is configured to output a defect signal $S_{DEF}$ dependent on comparing the string voltage signal S3 with the voltage threshold signal $S3_{TH}$. According to one example, the comparator 41 is configured to generate the defect signal $S_{DEF}$ such that the defect signal $S_{DEF}$ has a normal level or a defect level, wherein the defect level indicates that a defect has been detected. According to one example, the comparator 41 is configured to generate the defect level each time the string voltage V3 as represented by the string voltage signal S3 falls below the voltage threshold $V3_{TH}$ as represented by the voltage threshold signal $S3_{TH}$.

According to one example, the comparator 41 receives the string voltage signal S3 at an inverting input and the voltage threshold signal $S3_{TH}$ at a non-inverting input, so that the defect signal $S_{DEF}$ has a low signal level whenever the string voltage signal S3 falls below the voltage threshold signal $S3_{TH}$. This, however, is only an example. The inverting and non-inverting input or the comparator 41 could be changed, so that a high signal level of the defect signal $S_{DEF}$ represents a defect.

Just as an example, the string voltage signal S3 is identical with the string voltage V3 in the example illustrated in FIG. 8. Equivalently, the voltage threshold signal $S3_{TH}$ may be identical with the voltage threshold $V3_{TH}$. This, however, is only an example. According to another example, the string voltage signal S3 is not identical with the string voltage V3 but in any way represents the string voltage V3. Equivalently, the voltage threshold signal $S3_{TH}$ may not be identical with the threshold voltage $V3_{TH}$ but in any way represent the voltage threshold $V3_{TH}$. In each case, however, comparing the string voltage signal S3 with the voltage threshold signal $S3_{TH}$ is equivalent to comparing the string voltage V3 with the voltage threshold $V3_{TH}$.

In the example illustrated in FIG. 8, the string voltage V3 is referenced to a second input node 12 of the electronic circuit, wherein the second input node 12 may be a ground node of the electronic circuit. In this example, the voltage threshold generation circuit 42 is also connected to the second input node 12 and the voltage threshold signal $S3_{TH}$ is a signal referenced to the second input node 12. This, however, is only an example. According to another example illustrated in FIG. 9, the string voltage V3 is a voltage between the first input node 11 and the second string node 32. In this example, the voltage threshold generation circuit 42 generates the voltage threshold signal $S3_{TH}$ such that this signal is referenced to the first input node 11.

Figure 9:
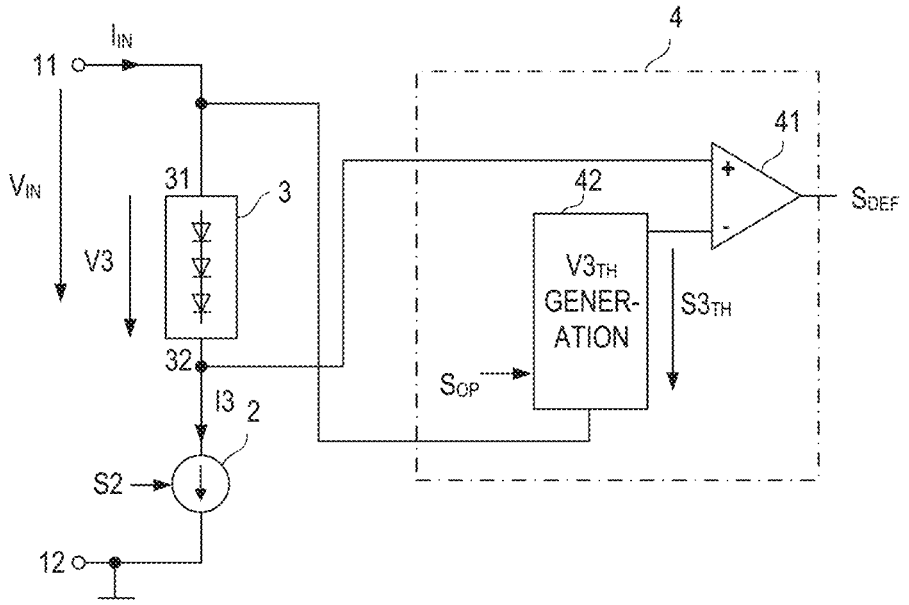
FIG. 9 shows a modification of the circuit arrangement shown in FIG. 8.

Referring to FIGS. 8 and 9, the voltage threshold generation circuit 42 receives an operating parameter signal Sop, wherein the operating parameter signal Sop represents at least one operating parameter of the electronic circuit.

Figure 10:
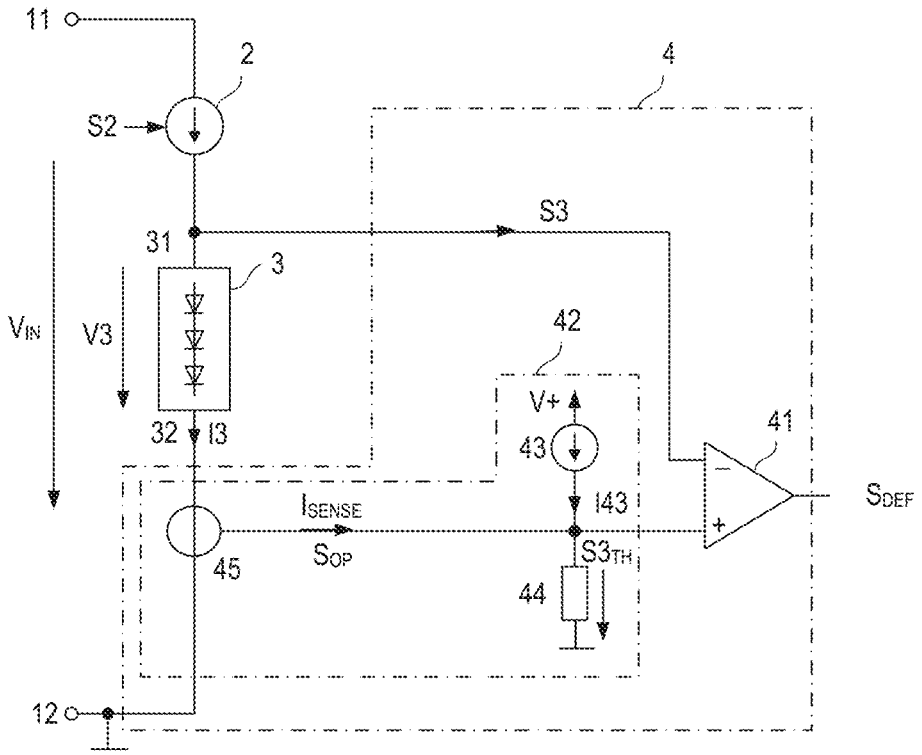
FIG. 10 illustrates one example of a defect detection circuit that is configured to adjust a threshold based on a current through the LED string.

According to one example, the detected operating parameter is the string current I3. In this example, the operating parameter signal Sop represents the string current I3. A defect detection circuit 4 configured to detect the string current I3 and generate the voltage threshold signal $S3_{TH}$ based on the detected string current I3 is illustrated in FIG. 10. In this example, the voltage threshold generation circuit 42 includes a current sensor 45 that is configured to sense the string current I3 and provide a sense current $I_{SENSE}$ that represents the string current I3. The current sensor 45 can be any kind of current sensor configured to sense the string current I3 and provide a current $I_{SENSE}$ that represents the string current I3. According to one example, the sense current $I_{SENSE}$ is proportional to the string current I3. In this example, the voltage threshold generation circuit 42 is configured to generate the voltage threshold signal $S3_{TH}$ (which is identical with the voltage threshold $V3_{TH}$) such that the voltage threshold signal $S3_T$H increases as the sense current $I_{SENSE}$ increases and, therefore, as the string current I3 increases. In this way, variations of the string voltage V3 that are due to variations of the string current I3 can be compensated in the detection of a defect such as an LED short.

In the example shown in FIG. 1*o*, the voltage threshold $V3_{TH}$ is a voltage across a resistor 44, wherein a constant current I43 provided by a current source 43 and the sense current $I_{SENSE}$ are driven through this resistor 44. Thus, the voltage threshold $V3_{TH}$ is proportional to an overall current given by the constant current I43 and the sense current $I_{SENSE}$ and the voltage threshold $V3_{TH}$ increases as the sense current $I_{SENSE}$, which represents the string current I3, increases.

Figure 11:
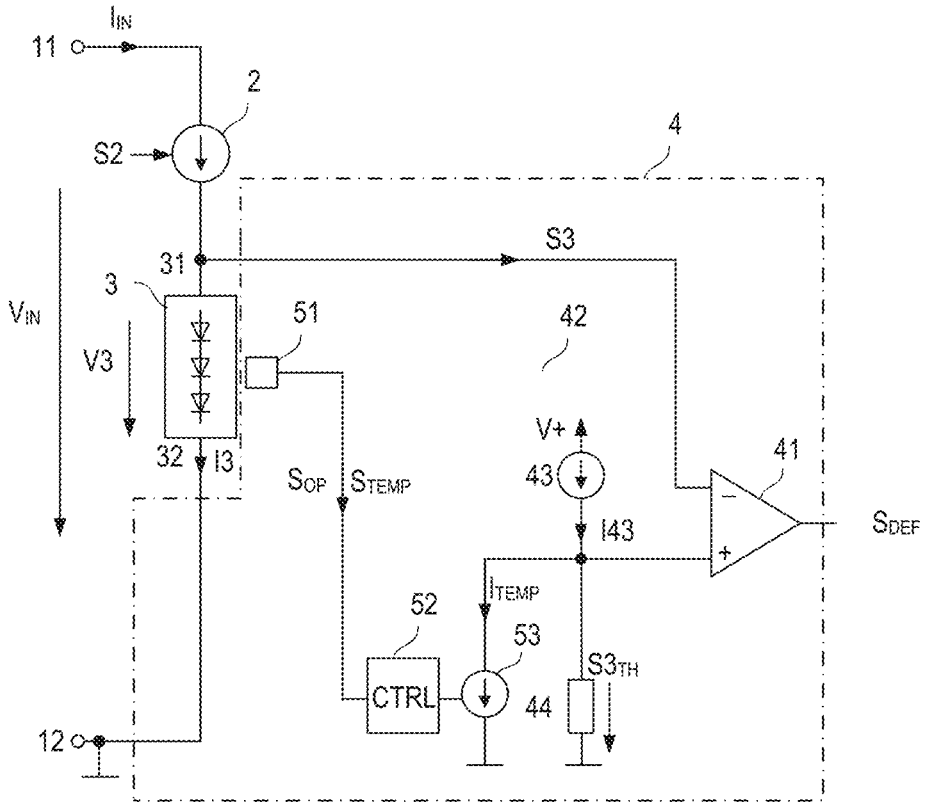
FIG. 11 illustrates one example of a defect detection circuit that is configured to adjust a threshold based on a temperature of the LED string.

According to another example, the operating parameter is a temperature of the LED string 3 so that the operating parameter signal Sop represents the temperature of the LED string 3. A defect detection circuit 4 configured to generate the voltage threshold signal $S3_{TH}$ dependent on the temperature of the LED string 3 is illustrated in FIG. 11. In this example, the voltage threshold generation circuit 42 includes a temperature sensor 51 configured to sense a temperature of the LED string 3 and output a temperature signal $S_{TEMP}$ that represents the string temperature. This temperature signal $S_{TEMP}$ is the operating parameter signal Sop in this example. A control circuit 52 receives the temperature signal $S_{TEMP}$ and drives a variable current source 53 dependent on the temperature signal $S_{TEMP}$.

According to one example, the control circuit 52 is configured to drive the current source 53 such that a current $I_{TEMP}$ provided by the current source 53 increases as the string temperature represented by the temperature signal $S_{TEMP}$ increases. The defect detection circuit includes the constant current source 43 and the resistor 44 already explained with reference to FIG. 10, wherein the variable current source 53 is connected in parallel with the resistor 44. In this way, the current I44 through the resistor is proportional to a difference between the constant current I44 and the temperature dependent current $I_{TEMP}$ and decreases as the temperature dependent current $I_{TEMP}$ increases. In this way, the voltage threshold signal $S3_{TH}$ decreases as the temperature dependent current $I_{TEMP}$ increases, that is, as the string temperature increases. In this way, the voltage threshold $V3_{TH}$ represented by the voltage threshold signal $S3_{TH}$ can be generated such that it is between the faultless level $V3_N$ and the defect level $V3_D$ even when these voltage levels decrease with increasing temperature, as illustrated in FIG. 3. Thus, variations of the string voltage V3 that are due to variations of the string temperature can be compensated in the detection of a defect such as an LED short.

Figure 12:
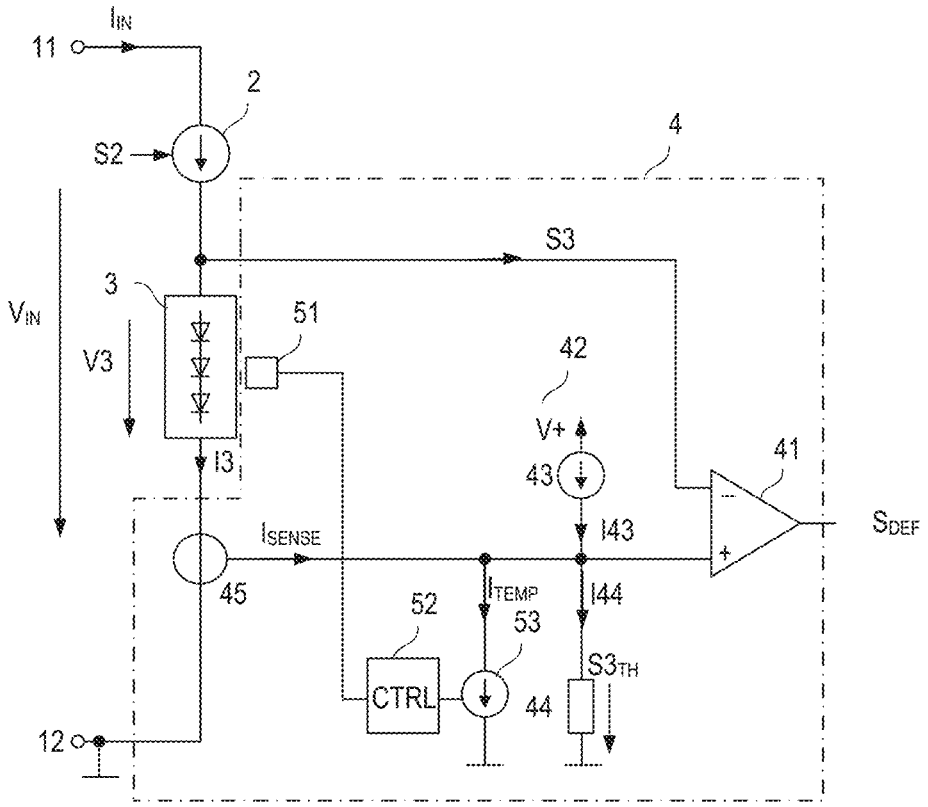
FIG. 12 illustrates one example of a defect detection circuit that is configured to adjust a threshold based on both a current through the LED string and a temperature of the LED string.

FIG. 12 shows one example of a defect detection circuit 4 that is configured to generate the voltage threshold signal S3TH dependent on both, the string current I3 and the string temperature. This defect detection circuit 4 includes the current sensor 54 illustrated in FIG. 10 and the temperature sensor 51, the control circuit 52 and the variable current source 43 illustrated in FIG. 11. In this example, the current I44 through the resistor 44 is given by the constant current I43 provided by the current source 43 plus the sense current $I_{SENSE}$ minus the temperature dependent current $I_{TEMP}$. In this way, the voltage threshold signal $S3_{TH}$ increases as the sensor current $I_{SENSE}$ increases and decreases as the temperature dependent current $I_{TEMP}$ increases. In this way, the voltage threshold signal $S3_{TH}$ can be generated such that—despite variations of the string temperature and the string current I3—it is between the faultless level $V3_N$ and the defect level $V3_D$. In this way, variations of the string voltage V3 that are due to variations of the string current I3 and variations of the string temperature can be compensated in the detection of a defect such as an LED short.

Figure 13:
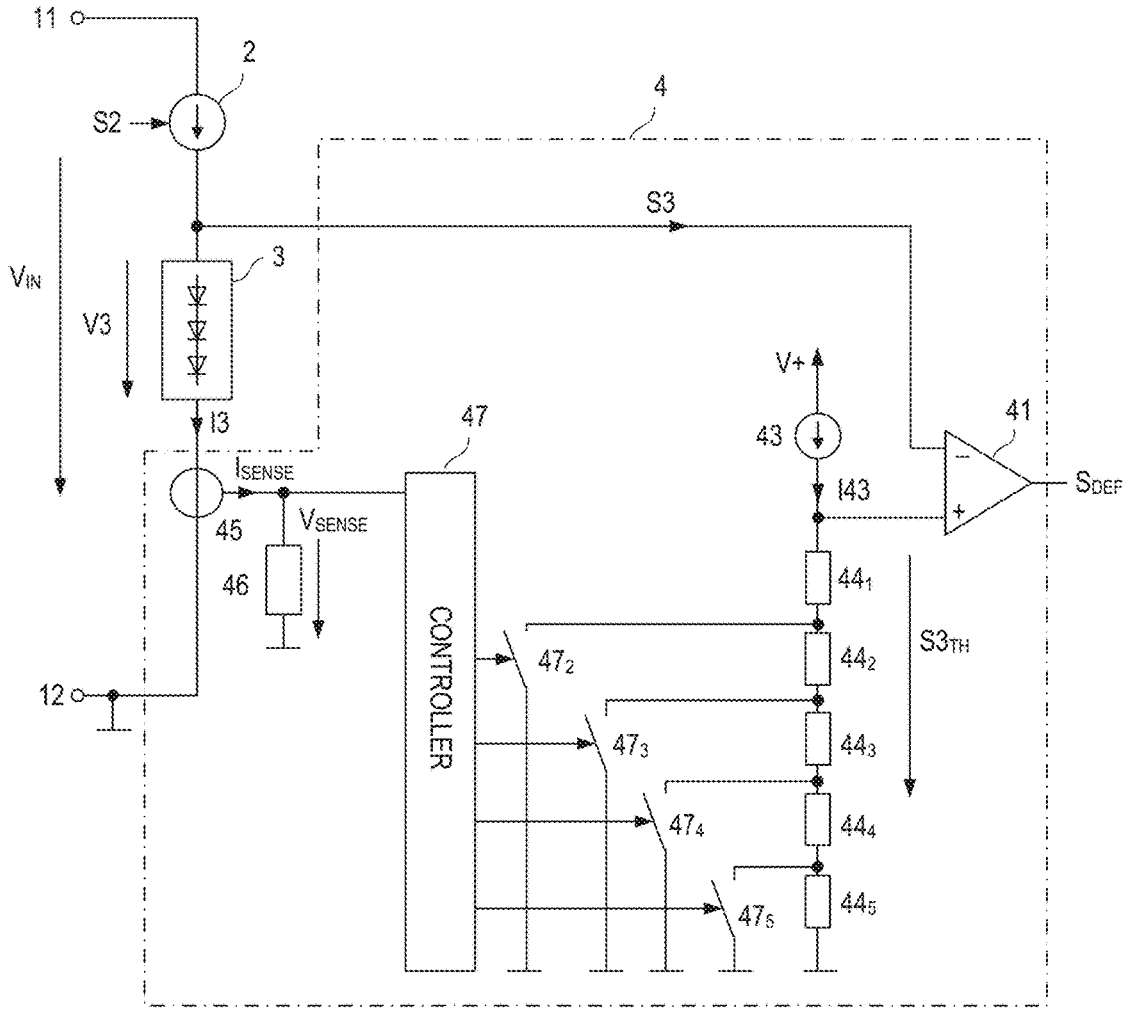
FIG. 13 illustrates another example of a defect detection circuit that is configured to adjust a threshold based on a current through the LED string.

In the example illustrated in FIG. 10, the voltage threshold signal $S3_{TH}$ continuously changes as the string current I3 and, therefore, the sense current $I_{SENSE}$ changes. Another example of the defect detection circuit 4 that is configured to generate the voltage threshold signal $S3_{TH}$ such that the voltage threshold signal $S3_{TH}$ increases step-wise as the string current I3 increases is illustrated in FIG. 13. In this example, a switch controller 47 receives a sense voltage $V_{SENSE}$, wherein the sense voltage $V_{SENSE}$ represents the string current I3. According to one example, the sense voltage $V_{SENSE}$ is proportional to the string current I3. The sense voltage $V_{SENSE}$ may be generated by a current sensor 45 of the type explained with reference to FIG. 10 and a resistor 46 connected in series with the current sensor 45 and receiving the sense current $I_{SENSE}$ so that a voltage across the resistor 46 is proportional to the sense current $I_{SENSE}$ and forms the sense voltage $V_{SENSE}$.

The switch controller 47, which may include an analog-to-digital converter (ADC), receives the sense voltage $V_{SENSE}$ and drives one of a plurality of switches $47_2$-$47_5$ dependent on the sense voltage $V_{SENSE}$. Each of these switches $47_2$-$47_5$ is connected to a respective tap of a resistive voltage divider $44_1$-$44_5$, wherein this voltage divider $44_1$-$44_5$ is connected in series to the current source 43 and wherein the voltage threshold signal $S3_{TH}$ is available across the resistive voltage divider $44_1$-$44_5$. The resistive voltage divider $44_1$-$44_5$ includes a plurality of resistors $44_1$-$44_5$ connected in series between the current source 43 and a reference node, which is the second input node 12 in this example. A circuit node between the current source 43 and the resistive voltage divider $44_1$-$44_5$ is connected to that input of the comparator 41 that receives the voltage threshold signal $S3_{TH}$ (this comparator input is the non-inverting input in this example). Two of the plurality of resistors $44_1$-$44_5$ are connected to each tap, wherein each of the switches $47_2$-$47_5$ controlled by the controller is connected between a respective tap and the reference node. The "reference node" is the circuit node to which the voltage threshold signal $S3_{TH}$ is referenced to. In the on-state, each of these switches $47_2$-$47_5$ bypasses at least one of the resistors $44_1$-$44_5$. Switch $47_2$, for example, bypasses resistors $44_2$-$44_5$, switch $47_3$ bypasses resistors $44_3$-$44_5$, and so on. Thus, a resistance of the resistive voltage divider between the input of the comparator 41 and the reference node and, therefore, the voltage threshold signal $S3_{TH}$ can be varied by switching on a respective one of the switches $47_2$-$47_5$. In the example shown in FIG. 13, the resistive voltage divider $44_1$-$44_5$ has the highest resistance when each of the switches $47_2$-$47_5$ is switched off and has the lowest resistance when switch $47_2$ is switched on. Basically, the controller 47 is configured to drive the switches $47_2$-$47_5$ such that the number of resistors that are bypassed by switching on a respective one of the switches $47_2$-$47_5$ decreases as the current sense signal $V_{SENSE}$ increases. In this way, the voltage threshold signal $S3_{TH}$ increases in discrete steps as the current sense signal $V_{SENSE}$ increases.

In the example illustrated in FIG. 13, the switch controller 47 receives a signal $V_{SENSE}$ representing the string current I3 in order to adjust the voltage threshold signal $S3_{TH}$ dependent on the string current. This, however, is only an example. According to another example (not shown) the controller 47 receives the temperature signal $S_{TEMP}$ and drives the switches $47_2$-$47_5$ such that the number of resistors that are bypassed by switching on a respective one of the switches $47_2$-$47_5$ increases as the temperature signal $S_{TEMP}$ increases. In this way, the voltage threshold signal $S3_{TH}$ decreases in discrete steps as the temperature signal $S_{TEMP}$ increases.

Figure 14:
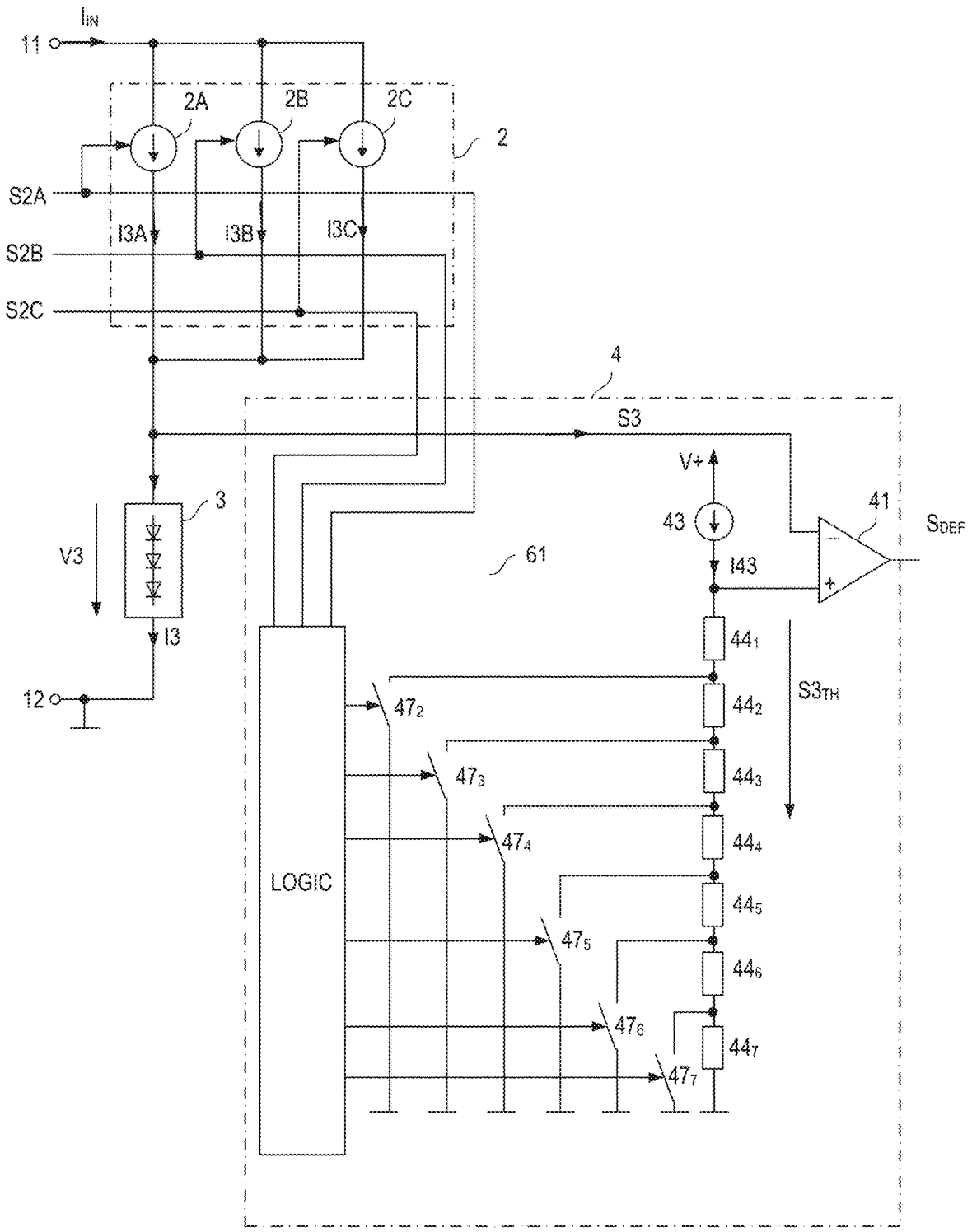
FIG. 14 illustrates another example of a defect detection circuit that is configured to adjust a threshold based on a current through the LED string.

In the example illustrated in FIG. 13, the string current I3 is measured and the voltage threshold signal $S3_{TH}$ is adapted based on the measured string current I3. FIG. 14 shows a modification of the circuit illustrated in FIG. 13. In the example illustrated in FIG. 14, the current source 2 is a controlled current source that provides the string current I3 dependent on a control signal. More specifically, the current source 2 illustrated in FIG. 14 includes three sub-sources 2A, 2B, 2C connected in parallel. The control signal includes three sub-signals S2A, S2B, S2C, wherein each of these sub-signals controls one of the sub-sources 2A, 2B, and 2C. Each of these current sources 2A, 2B, 2C is configured to provide a sub-current I3A, I3B, I3C, wherein the string current I3 is given by the sum of the sub-currents I3A, I3B, I3C provided by the current source 2A, 2B, 2C. According to one example, the current provided by each of the sub sources 2A, 2B, 2C is either zero or a predefined current level, wherein this predefined current level can be the same for each of the sub-sources 2A, 2B, and 2C or can be different. Whether the current provided by one sub-source 2A, 2B, and 2C is zero or has the predefined current level different from zero is dependent on the respective control signal S2A, S2B, S2C. Using a current source 2 of the type illustrated in FIG. 14, $2^N-1$ different current levels, each being different from zero, can be generated. N is the number of sub-sources "–C, wherein N=3 in the example shown in FIG. 14.

Referring to FIG. 14, the defect detection circuit 4 receives the control signals S2A, S2B, S2C, and adjusts the voltage threshold signal $S3_{TH}$ dependent on these control signals S2A-S2C. More specifically, a logic circuit 61 receives the control signals S2A, S2B, S2C and adjusts the voltage threshold signal $S3_{TH}$ by bypassing two or more resistors of a resistive voltage divider $44_1$-$44_4$ dependent on the control signal S2A-S2C. The arrangement shown in FIG. 14 includes $2^N-1$ resistors connected in series and $2^N-2$ switches $47_2$-$47_7$ so that $2^N-1$ different resistances and, therefore, $2^N-1$ different levels of the voltage threshold signal $S3_{TH}$ can be adjusted. Each of these levels of the voltage threshold signal $S3_{TH}$ is associated with one of the different current levels of the string current I3.

Figure 15:
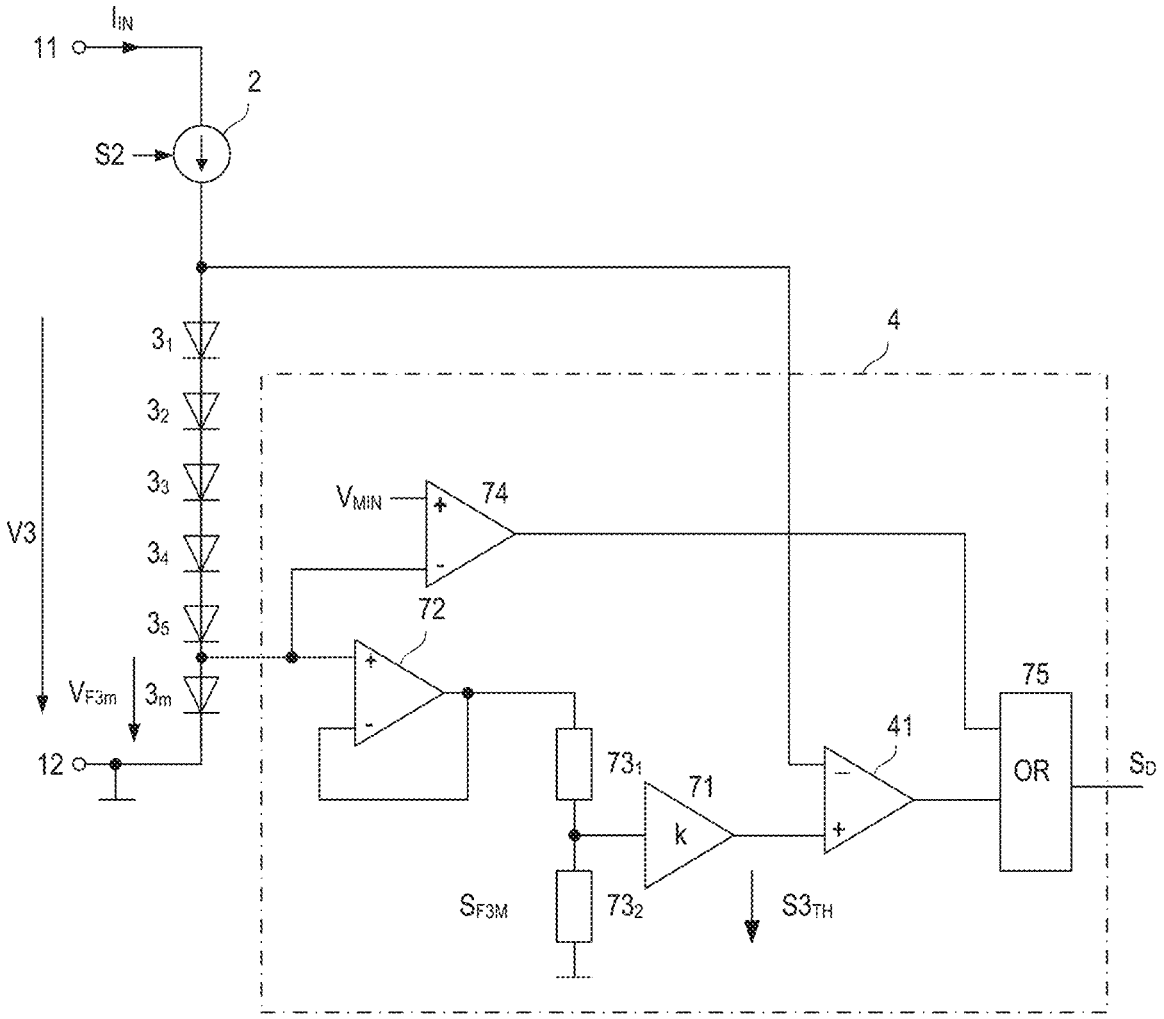
FIG. 15 illustrates one example of a defect detection circuit that is configured to adjust a threshold based on a forward voltage of an LED in the LED string.

FIG. 15 illustrates a defect detection circuit 4 according to another example. In this example, the defect detection circuit 4 is configured to detect a forward voltage $V_{F3m}$ of one of the plurality of LEDs $3_1$-$3_m$ of the LED string 3 and adjusts the voltage threshold signal $S3_{TH}$ based on the detected forward voltage $V_{F3m}$. According to one example, the voltage threshold signal $S3_{TH}$ is generated such that the voltage threshold signal $S3_{TH}$ increases as the detected forward voltage $V_{F3m}$ increases. In the example, shown in FIG. 15, an amplifier 71 receives a forward voltage signal $S_{F3m}$ that represents the forward voltage $V_{F3m}$ and generates the voltage threshold signal $S3_{TH}$ at an output. According to one example (not shown), the forward voltage signal $S_{F3m}$ is the forward voltage $V_{F3m}$, that is, the amplifier may be connected to the LED $3_m$. According to another example, illustrated in FIG. 15, a buffer 72 receives the forward voltage $V_{F3m}$ and provides forward voltage signal SF3*m* either direct or, as illustrated, via an optional voltage divider $73_1$, $73_2$.

Like in the examples explained herein before, the string voltage signal S3, which equals the string voltage V3 in this example, and the voltage threshold signal $S3_{TH}$ are received by a comparator 41 that generates the defect signal $S_{DEF}$. Optionally, a further comparator 74 compares the forward voltage $V_{F3m}$ with a minimum voltage $V_{MIN}$, wherein an output signal of the comparator 41 and the further comparator 74 are received by a logic gate such as an OR-gate 75 and the defect signal $S_{DEF}$ is provided by the logic gate 75. In this example, a defect level of the defect signal $S_{DEF}$ is generated each time the forward voltage $V_{F3m}$ falls below a voltage represented by the voltage threshold signal $S3_{TH}$ or the forward voltage $V_{3m}$ falls below the minimum voltage $V_{MIN}$. The latter may occurs an LED short in the LED $3_m$ occurs.

Figure 16:
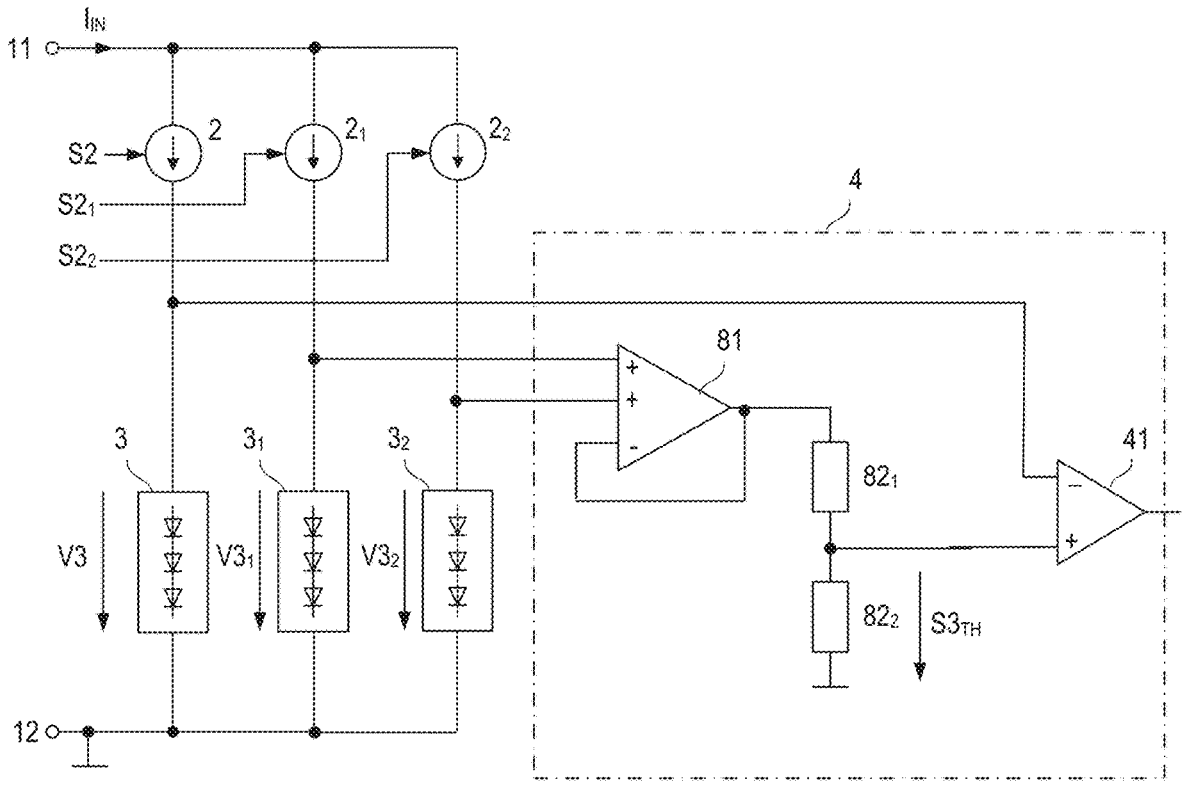
FIG. 16 illustrates one example of a defect detection circuit that is configured to adjust a threshold based on a string voltage of another LED string in the electronic circuit.

According to another example illustrated in FIG. 16, the electronic circuit includes several LED strings, the monitored LED string and at least one further LED string $3_1$, $3_2$, wherein in the example shown in FIG. 16 there are two further LED strings $3_1$, $3_2$. Each of the further LED strings $3_1$, $3_2$ is connected in series with a respective further current source $2_1$, $2_2$. These further LED strings $3_1$, $3_2$ are driven such that—when there is no defect in the further LED strings $3_1$, $3_2$—are essentially the same. Further, the string voltage V3 of the monitored LED string 3—when there is no defect in the monitored LED string 3—is essentially the same as the string voltages $V3_1$, $V3_2$ of these further LED strings $3_1$, $3_2$ or there is a predefined ratio between the string voltage V3 of the monitored LED string 3 and the string voltages $V3_1$, $V3_2$ of the further LED strings $3_1$, $3_2$.

It can be assumed that dependent on the temperature the string voltage V3 of the monitored LED string 3 and the string voltages $V3_1$, $V3_2$ of the further LED strings $3_1$, $3_2$ vary in the same way. Thus, in the example shown in FIG. 16, the voltage threshold signal $S3_{TH}$ is generated based on the string voltages $V3_1$, $V3_2$ of the further LED strings $3_1$, $3_2$. According to one example, a maximum selector 81 receives the string voltage $V3_1$, $V3_2$ of each of the further LED strings $3_1$, $3_2$ and outputs a signal representing the maximum of the further strings voltages $V3_1$, $V3_2$. In this way, generating a proper voltage threshold signal $S3_{TH}$ is ensured even if an LED short in one of the further LED strings $3_1$, $3_2$ occurs. A resistive voltage divider $82_1$, $82_2$ generates the voltage threshold signal based $S3_{TH}$ based on the output signal generated by the maximum selector 81. In this example, generating the voltage threshold signal $S3_{TH}$ considers the temperature although the temperature is not directly measured.

Figure 17:
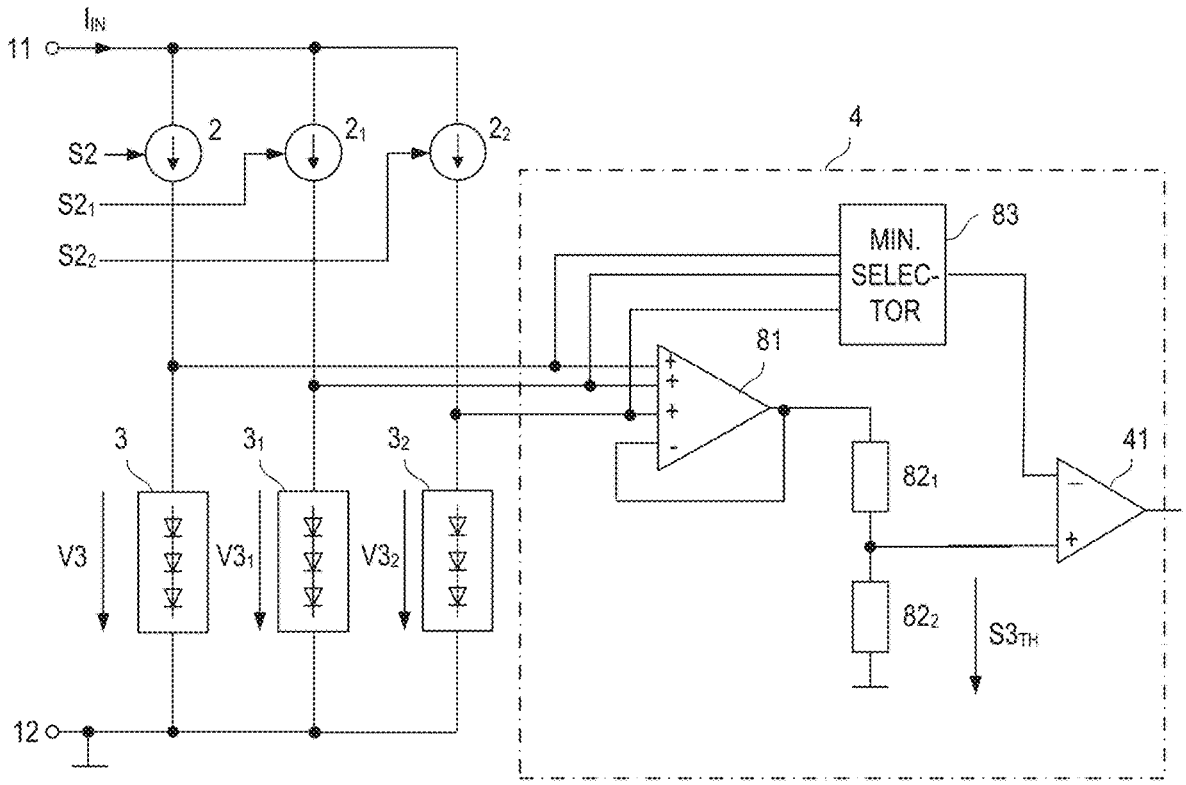
FIG. 17 shows a modification of the electronic circuit shown in FIG. 16.

According to yet another example illustrated in FIG. 17, each of the LED strings 3, $3_1$, $3_2$ illustrated in FIG. 16 is monitored for the occurrence of a defect. In this example, the maximum selector 81 receives each of the string voltages V3, $V3_1$, $V3_2$ and a minimum selector 83 receives each of the string voltages V3, $V3_1$, $V3_2$. An output signal of the minimum selector 83 is received by the second input of the comparator 41, which is the inverting input in this example.

While the invention has been described with reference to illustrative examples, this description is not intended to be construed in a limiting sense. Various modifications and combinations of the illustrative examples, as well as other examples of the invention, will be apparent to persons skilled in the art upon reference to the description. It is therefore intended that the appended claims encompass any such modifications or examples.

What is claimed is:

1. A method, comprising:

detecting at least one operating parameter in an electronic circuit that comprises a monitored LED string;

generating a voltage threshold at a first electronic circuit node that is a replica of a voltage having a value between a faultless voltage of the LED string and a defect voltage of the LED string using a voltage threshold generation circuit comprising a constant current source, a resistor, and a current sensor coupled to the first electronic node, wherein the current sensor is in series connection with the monitored LED string;

adjusting the voltage threshold at the first electronic circuit node based on the at least one detected operating parameter;

detecting a string voltage across the monitored LED string at a second electronic circuit node different than the first electronic circuit node;

comparing the string voltage with the voltage threshold; and detecting a defect in the LED string based on the comparing.

2. The method of claim 1, wherein the at least one operating parameter comprises a string current through the LED string; and wherein adjusting the voltage threshold comprises increasing the voltage threshold as the string current increases.

3. The method of claim 1, wherein the at least one operating parameter comprises an estimated temperature of the LED string; and wherein adjusting the voltage threshold comprises decreasing the voltage threshold as the estimated temperature increases.

4. The method of claim 1, wherein the electronic circuit comprises at least one further LED string, and wherein the at least one operating parameter comprises a string voltage of the at least one further LED string.

5. The method of claim 4, wherein the at least one further LED string comprises a plurality of further LED strings, and wherein the at least one operating parameter comprises a maximum of the string voltages of the plurality of further LED strings.

6. The method of claim 1, wherein the at least one operating parameter comprises a voltage across a monitored LED in the LED string, and wherein adjusting the voltage threshold comprises increasing the voltage threshold as the voltage increases.

7. The method of claim 6, further comprising:

detecting a defect when the voltage across the monitored LED falls below a predefined minimum value.

8. The method of claim 1, wherein the electronic circuit further comprises a variable current source, wherein the variable current source is connected in series with the monitored LED string and configured to provide a current with a variable amplitude dependent on a control signal, and wherein the at least one operating parameter comprises the control signal.

9. An electronic circuit, comprising:

a monitored LED string; and a defect detection circuit, wherein the defect detection circuit is configured:

to detect at least one operating parameter in the electronic circuit;

to generate a voltage threshold at a first electronic circuit node that is a replica of a voltage having a value between a faultless voltage of the LED string and a defect voltage of the LED string using a voltage threshold generation circuit comprising a constant current source, a resistor, and a current sensor coupled to the first electronic node, wherein the current sensor is in series connection with the monitored LED string;

to adjust the voltage threshold at the first electronic circuit node based on the at least one detected operating parameter;

to detect a string voltage across the monitored LED string at a second electronic circuit node different than the first electronic circuit node;

to compare the string voltage with the voltage threshold; and to detect a defect in the LED string based on the comparing.

10. The electronic circuit of claim 9, wherein the at least one operating parameter comprises a string current through the LED string; and wherein the defect detection circuit is configured to increase the voltage threshold as the string voltage increases.

11. The electronic circuit of claim 9, wherein the at least one operating parameter comprises an estimated temperature of the LED string; and wherein the defect detection circuit is configured to decrease the voltage threshold as the estimated temperature increases.

12. The electronic circuit of claim 9, further comprising:

at least one further LED string, wherein the at least one operating parameter comprises a string voltage of the at least one further LED string.

13. The electronic circuit of claim 12, wherein the at least one further LED string comprises a plurality of further LED strings, and wherein the at least one operating parameter comprises a maximum of the string voltages of the plurality of further LED strings.

14. The electronic circuit of claim 9, wherein the at least one operating parameter comprises a voltage across a monitored LED in the LED string, and wherein the defect detection circuit is configured to increase the voltage threshold as the voltage increases.

15. The electronic circuit of claim 14, wherein the defect detection circuit is further configured to detect a defect when the voltage across the monitored LED falls below a predefined minimum value.

16. The electronic circuit of claim 9, further comprising:

a variable current source connected in series with the monitored LED string and configured to provide a current with a variable amplitude dependent on a control signal, wherein the at least one operating parameter comprises the control signal and the defect detection circuit is configured to adjusted the voltage threshold based on the control signal.

* * * * *